United States Patent [19]

Roggeveen

[11] Patent Number: 4,548,147

[45] Date of Patent: Oct. 22, 1985

[54] HOPPER BARGE WITH BOTTOM FLAPS AND A SUCTION CHANNEL

[75] Inventor: Hans D. H. Roggeveen, Nieuw Lekkerland, Netherlands

[73] Assignee: IHC Holland N.V., Papendrecht, Netherlands

[21] Appl. No.: 575,542

[22] Filed: Jan. 31, 1984

[30] Foreign Application Priority Data

Feb. 2, 1983 [NL] Netherlands ..... 8300385

[51] Int. Cl.[4] ..... B63B 35/30

[52] U.S. Cl. ..... 114/36; 414/140; 406/128

[58] Field of Search ..... 114/26–38, 114/197, 198; 406/128; 105/240, 250; 414/140

[56] References Cited

U.S. PATENT DOCUMENTS

| | | | |
|---|---|---|---|
| 1,150,981 | 8/1915 | Walter | 114/26 |
| 1,187,250 | 6/1916 | Brown et al. | 114/26 |
| 1,403,017 | 1/1922 | Dunbar | 114/36 |
| 3,578,222 | 5/1971 | Pot | 114/36 |
| 4,120,409 | 10/1978 | vander Werff | 114/36 |
| 4,176,885 | 12/1979 | Alkema | 114/27 |
| 4,502,405 | 3/1985 | Langejan | 114/36 |

FOREIGN PATENT DOCUMENTS

| | | | |
|---|---|---|---|
| 18737 | 9/1928 | Netherlands . | |
| 6617871 | 6/1968 | Netherlands . | |
| 7601808 | 8/1977 | Netherlands . | |
| 7611507 | 4/1978 | Netherlands . | |
| 7708242 | 1/1979 | Netherlands | 114/27 |

*Primary Examiner*—Trygve M. Blix
*Assistant Examiner*—Stephen P. Avila
*Attorney, Agent, or Firm*—Young & Thompson

[57] ABSTRACT

Hopper barge comprising one or more cargo spaces and a series of discharge openings in the bottom of the hold. Each opening comprises a bottom flap which in the downwards displaced position realizes a connection between the hold through the respective discharge opening to the water outside the barge. The barge further comprises a suction channel extending in the longitudinal direction of the barge whereby the bottom flaps each have at least one wall assuring the continuity of the channel in case the flaps are completely closed and connecting the channel to the hold when a flap is in the intermediate position, in which the discharge opening is still closed. Each flap comprises a pivotally attached hollow body with a wall opposite the pivot shaft, which wall extends concentrically in relation to said shaft. The shafts of all flaps extend substantially parallel to the longitudinal direction of the barge and two longitudinal edges of the barge construction positioned above each other form sealing and/or stop edges cooperating with each flap in the upper closed position and in the intermediate suctioning position.

5 Claims, 3 Drawing Figures

HOPPER BARGE WITH BOTTOM FLAPS AND A SUCTION CHANNEL

The invention relates to a hopper barge comprising one or more cargo spaces and a series of discharge openings in the bottom of the hold, each opening having a bottom flap which in the downwards extending position realises the connection between the hold through the respective discharge opening to the water outside the barge. A suction channel extends in the longitudinal direction of the barge, the bottom flaps each having at least one wall which assures the continuity of said channel when the flaps are completely closed and connects said channel to the hold when a flap is brought into an intermediate position in which the discharge opening is still closed.

A hopper barge of this type is known for instance from the Dutch Patent Application No. 76,11507, which is laid open to public inspection. In this known construction the bottom flaps are pivotally connected to shafts, directed transverse to the longitudinal axis of the barge, which shafts have relatively large dimensions viewed in the longitudinal direction of said barge, so that in the completely opened position said flaps are able to reach far underneath the bottom of the barge. In shallow waters this may cause problems. The suction channel in this known construction is embodied as a channel extending in the longitudinal direction of the barge and is formed by conduit sections which are installed in the respective bottom flaps, which conduit sections are aligned when all the flaps are in the closed position. Because of their large dimensions and because of the positioning of the flaps pivotally around transverse shafts, relatively large forces can act on said flaps making this known construction rather expensive.

An object of the invention is to provide a hopper barge with bottom flaps and a suction channel, the construction of which can be simple, the flaps not or only slightly extending downwards beneath the bottom when the flaps are completely opened.

Said object is according to the invention fulfilled in that each flap comprises a pivotally attached hollow body with a wall opposite the pivot shafts, which wall is concentric to said shaft, the shafts of all flaps extending substantially parallel to the longitudinal direction of the barge and two longitudinal edges of the construction of the barge positioned above each other forming the sealing and/or step edges cooperating with each flap in the uppermost closed position and in the intermediate or suctioning position. Such a flap can have relatively large dimensions in the longitudinal barge direction and relatively small dimensions in the transverse barge direction, so that with a sufficiently large discharge opening flaps can be realised which are incorporated into the bottom construction such that they will not or only slightly extend beneath the bottom when they are in the downwards directed completely open position. The end wall of said flaps, extending concentrically in relation to the pivot shaft, assures a proper seal in the closed position as well as in the intermediate position of said flaps.

The flaps themselves might form the suction channel if each flap is open at the front and rear side and comprises furthermore an upper wall and a lower wall, both walls extending from the pivot shaft, and there being furthermore a cylinder section shaped wall connecting the end edges of the upper wall and the lower wall to each other.

However the suction channel might be positioned at an adjacent location if the suction channel is defined at that side of the series of flaps where the walls concentric with the pivot shafts of the flaps are positioned and the longitudinal edges of the barge construction define in an intermediate position of the flap the inlet of the suction channel.

A combination is furthermore possible by realising the suction channel adjacent to the flaps and making the flaps themselves open at the front and rear side.

As soon as the flap is placed in the intermediate position the respective section of the hold above said flap will become connected to the suction channel irrespective of the embodiment of said channel by a series of aligned closed hollow flaps or the adjacent suction channel respectively in that both the hollow flaps and the adjacent suction channel define a channel with a large passageway.

A very efficient embodiment is realised if according to the invention the suction channel is positioned inbetween two series of flaps.

It might be advantageous in all embodiments if the flaps are embodied as sector flaps.

It is to be noted that the Dutch Patent Application 66,17871, which is laid open to public inspection, describes a downwards discharging hopper vessel comprising sector shaped flaps. This special vessel is destined for transport of fluid garbage and the sector flaps are positioned at the front and rear end of the hold and are rotatable around shafts transverse to the longitudinal axis of the vessel. Discharging is realised in that with the flaps rotated upwards into the opened position, and therefore not downwards, the moving vessel generates a longitudinal current through the hold with the result that the hold becomes discharged.

With the flaps according to the invention a proper seal is possible. That offers the possibility to realise a system for automatic dewatering in that according to the invention one or more flaps have a filter in their upper surface with a drain conduit opening into the suction channel when the flap is in the closed position. Water coming out of the cargo will through the filter reach the suction channel and will be suctioned off therefrom. In this way an increased amount of solid material will be transported.

The invention will now be explained in more detail with reference to the drawings.

FIG. 1 illustrates the bottom part 1 of a hopper barge and a side wall section 2. The bottom of the hold is indicated by 3 and the side wall of the hold is indicated by 4.

Figure 1:
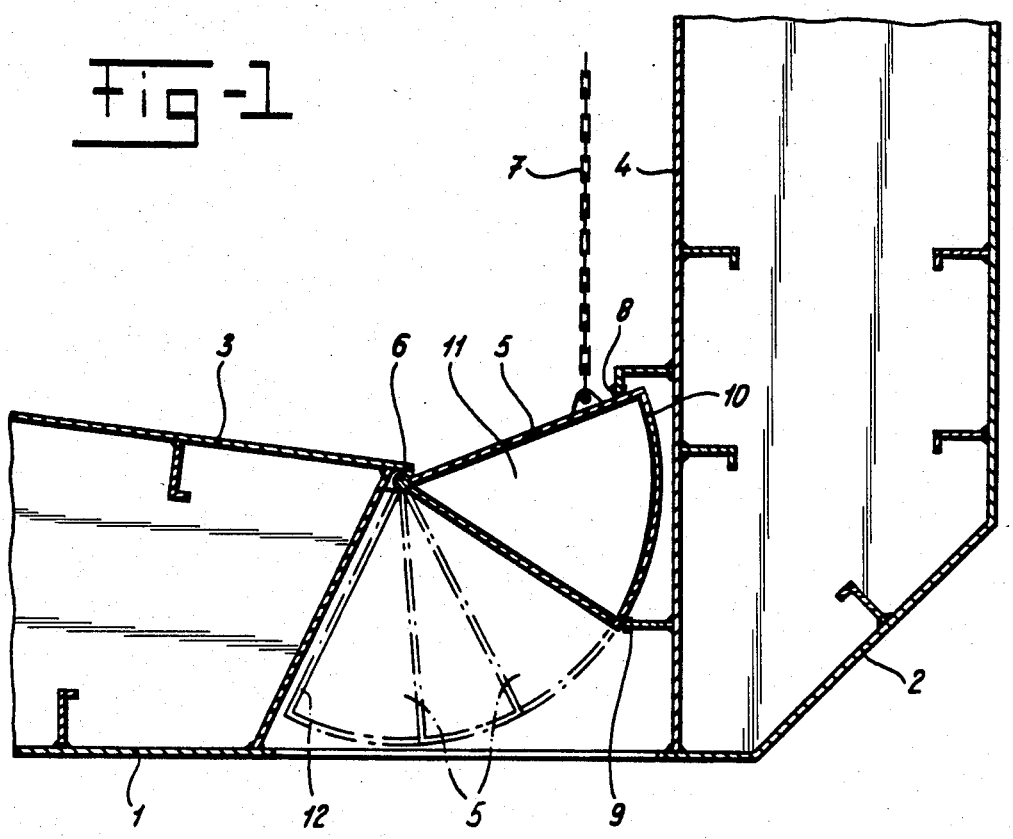
FIG. 1 illustrates a transverse cross section through a lower part of the hold of a vessel in an embodiment according to the invention.

The flaps 5 are installed in the bottom pivotably connected at 6 and comprise an operating means, for instance a chain 7 or a cyliner attached to an arm connected to the flap 5 and situated (in a not illustrated way) in the bottom construction. Near the bottom opening the hold has two longitudinal edges, the upper edge 8 and the lower edge 9. In the illustrated closed position of the flap 5 said flap is sealed in a proper way against the upper edge 8 and the lower edge 9. If the flap is lowered over such a distance that the upper surface 10 is situated adjacent to the lower edge 9 then the hold is still closed. The flaps illustrated in this figure have an opening at the front side and the back side. Therefore the aligned flaps define a channel which may function as suction channel 11. A flap of which the upper surface 10 is situated adjacent to the lower longitudinal edge 9 connects the hold above said flap with the inlet of the adjacent flap, which is still in the closed position. Water can now enter and take care of the discharge of the cargo inside the hold, either by maintaining the flap 5 somewhat above the intermediate position, so that water from outside the vessel can enter, or coming from a preceding cargo space, which is already emptied.

The pivot shaft in the embodiment illustrated in FIG. 1 is positioned at such a height that in the completely opened situation, indicated by 12, the flap does not extend below the bottom.

Figure 2:
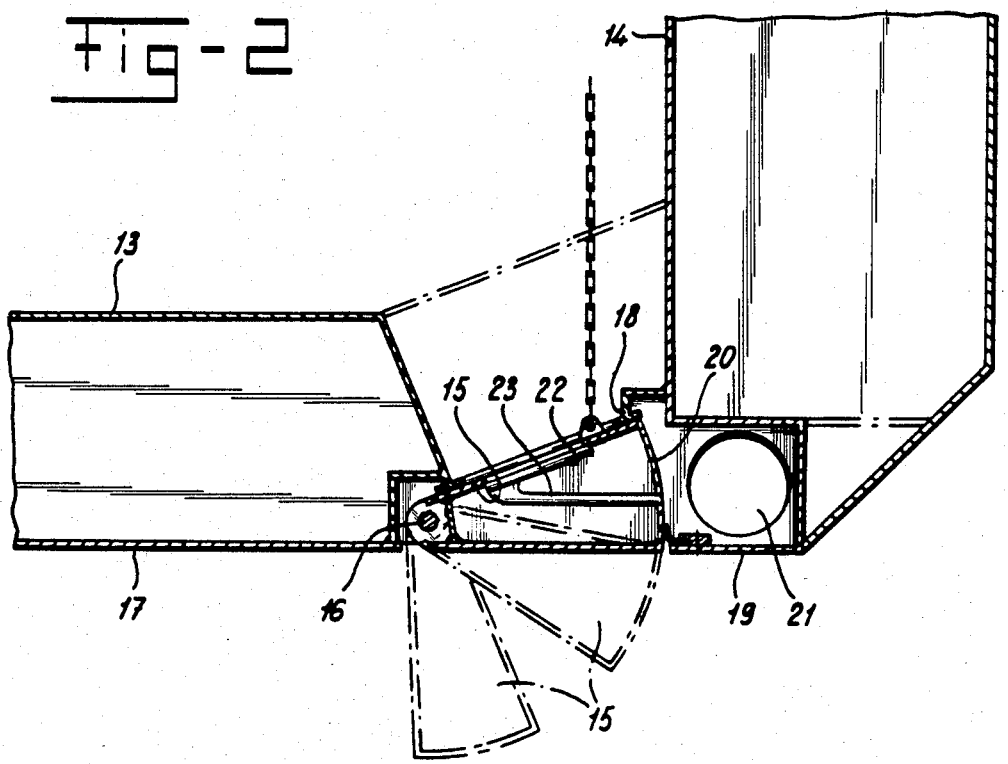
FIG. 2 illustrates in a corresponding cross section a second embodiment.

FIG. 2 illustrates an embodiment of which the bottom of the hold is indicated by 13 and the side wall indicated by 14 and wherein the bottom flap 15 is pivotally attached to a pivot shaft 16. This shaft is positioned at a low level such that in the completely opened downwards directed position the flap will extend beneath the bottom 17.

Said vessel construction also has two longitudinal edges, the upper edge 18 and the lower edge 19, to which the cylinder section shaped wall 20 of the flap closes.

In this embodiment the suction channel is positioned adjacent to the series of flaps and is indicated by 21. In the illustrated closed position of the flaps 20 the hold is completely separated from the suction channel. If one of the flaps is lowered into the intermediate position then a connection is created between the hold and the suction channel 21.

In this embodiment the flaps may have end walls, so that the suction channel is exclusively defined by the channel 21 adjacent to said flaps. However, said flaps may also be embodied as indicated in FIG. 1 without end walls, so that the suction channel is defined both by the adjacent channel as well as by the hollow spaces inside the flaps.

In this embodiment the upper surface of the flaps comprises a filter 22 which through a conduit 23 opens into the suction channel 21. Thereby it is possible to drain water from the cargo and to transport therefore a relatively dry cargo. If desired, one can use water injectors for discharging the dry cargo. Said means 22, 23 for dewatering the cargo inside the hold can be used in all the embodiments.

Figure 3:
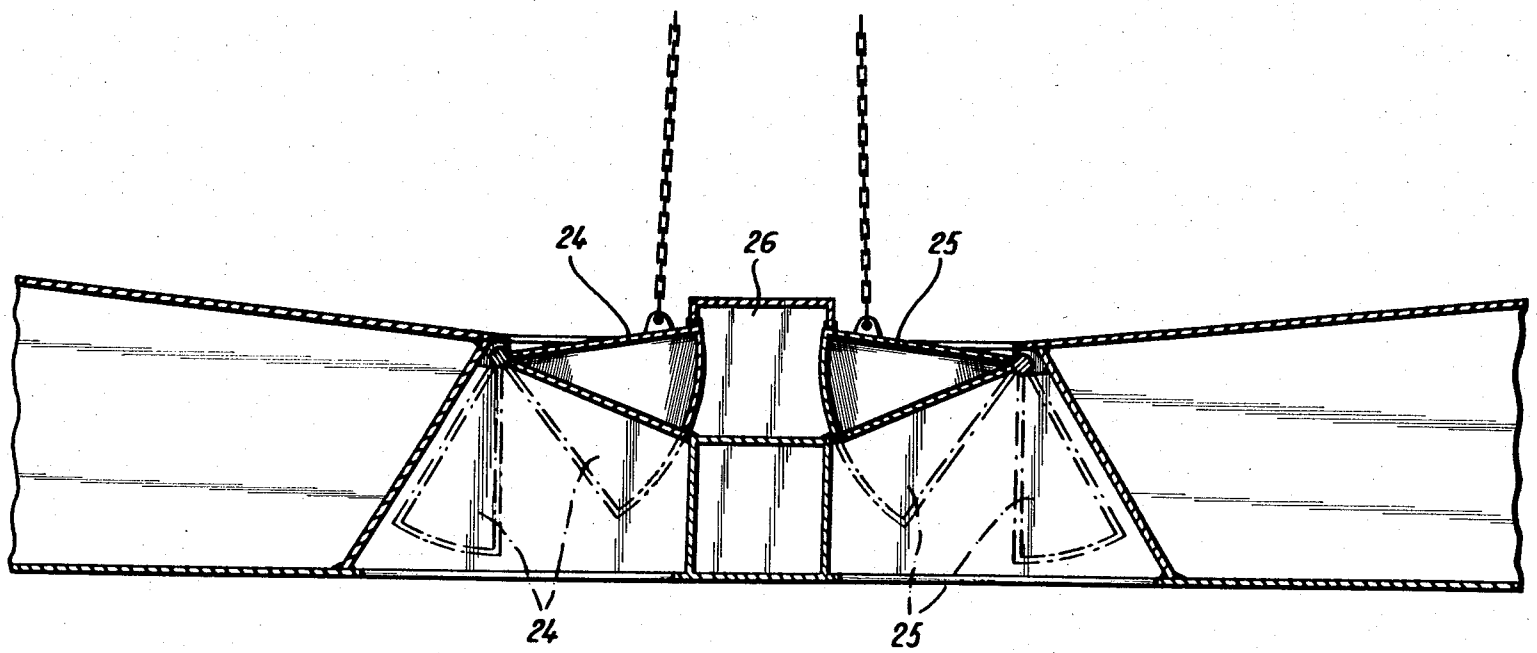
FIG. 3 illustrates a third embodiment in a similar way.

In the embodiment illustrated in FIG. 3 in essence the same flap as illustrated in FIG. 1 is used, however with the difference that now two series of flaps 24, 25 are positioned at both sides of a common suction channel 26.

I claim:

1. In a hopper barge comprising one or more cargo spaces and a series of discharge openings in the bottom of the hold, each opening having a bottom flap which in the downwards displaced position realizes a connection between the hold through the respective discharge opening to the water outside the barge and further comprises a suction channel extending in the longitudinal direction of the barge wherein the bottom flaps each have at least one wall which assures the continuity of the channel in case the flaps are completely closed and connects said channel to the hold when the flap is in an intermediate position in which the discharge opening is still closed; the improvement in which each flap comprises a hollow body with a pivot shaft extending along one side of the hollow body and with a wall on the side of the body opposite the pivot shaft, which wall extends concentrically in relation to said shaft from top to bottom of said opposite side of said hollow body, the shafts of all flaps extending substantially parallel to the longitudinal direction of the barge and portions of the barge construction positioned above each other forming sealing and stop means cooperating with each flap in the upper closed position and in the intermediate suctioning position, said portions comprising an upper longituinal edge that stops the flaps in their closed position and a lower longitudinal edge that seals against said opposite wall in the closed and intermediate positions of the flaps.

2. Barge according to claim 1, in which each flap is open at the front and rear side and comprises an upper wall, a lower wall, which upper and lower wall extend from the pivot shaft, as well as a cylinder section shaped wall, connecting the edges of the upper wall and the lower wall with each other.

3. Barge according to claim 1, in which the suction channel is positioned at that side of the series of flaps where the flaps have their wall which is concentric with the pivot shaft, and said portions of the barge construction define in said intermediate position of the flap the inlet of the suction channel.

4. Barge according to claim 1, in which the suction channel is positioned between two series of said flaps.

5. Barge according to claim 1, in which at least one said flap has in its upper surface a filter with a drain conduit opening into the suction channel when the flap is in the closed position.

* * * * *